US008900007B2

(12) United States Patent
Nonen et al.

(10) Patent No.: US 8,900,007 B2
(45) Date of Patent: Dec. 2, 2014

(54) CABLE CONNECTOR AND CABLE ASSEMBLY, AND METHOD OF MANUFACTURING CABLE ASSEMBLY

(71) Applicant: Hitachi Cable, Ltd., Tokyo (JP)

(72) Inventors: Hideki Nonen, Hitachi (JP); Yosuke Ishimatsu, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 85 days.

(21) Appl. No.: 13/795,246

(22) Filed: Mar. 12, 2013

(65) Prior Publication Data

US 2014/0154927 A1 Jun. 5, 2014

(30) Foreign Application Priority Data

Nov. 30, 2012 (JP) ..... 2012-261954

(51) Int. Cl.

| | |
|---|---|
| ***H01R 12/24*** | (2006.01) |
| ***H01R 9/03*** | (2006.01) |
| ***H01R 43/26*** | (2006.01) |
| *H01R 43/02* | (2006.01) |
| *H01R 12/62* | (2011.01) |

(52) U.S. Cl.

CPC ..... *H01R 43/26* (2013.01); *H01R 43/0207* (2013.01); *H01R 12/62* (2013.01); *H01R 9/037* (2013.01)

USPC ..... 439/497

(58) Field of Classification Search

USPC ..... 439/497, 579

See application file for complete search history.

(56) References Cited

U.S. PATENT DOCUMENTS

| | | | | |
|---|---|---|---|---|
| 6,942,509 | B2 * | 9/2005 | Sasame et al. | 439/181 |
| 7,862,344 | B2 * | 1/2011 | Morgan et al. | 439/67 |
| 2007/0149058 | A1 * | 6/2007 | Saito | 439/608 |
| 2012/0061140 | A1 | 3/2012 | Nonen et al. | |
| 2013/0005165 | A1 * | 1/2013 | Ikegami et al. | 439/108 |

FOREIGN PATENT DOCUMENTS

| | | |
|---|---|---|
| JP | 2012-99434 | 5/2012 |

* cited by examiner

*Primary Examiner* — Phuong Dinh

(74) *Attorney, Agent, or Firm* — Antonelli, Terry, Stout & Kraus, LLP.

(57) ABSTRACT

A cable connector and a cable assembly in which electrical characteristics are stabilized by suppressing elastic deformation of a cable for differential signal transmission, and besides, which are easily connectable by reducing the number of parts, and a method of manufacturing the cable assembly are provided. Respective ground contacts and respective signal line contacts positioned between the respective ground contacts through a space are provided in a connector main body. Front-side arm portions and rear-side arm portions mutually extending toward the respective signal line contacts are integrally provided with end portions of the respective ground contacts protruded from a side wall portion of the connector main body. And, under a state that respective signal line conductors are arranged in the respective signal line contacts, an outer conductor is held by the front-side arm portions and the rear-side arm portions.

18 Claims, 13 Drawing Sheets

CABLE CONNECTOR AND CABLE ASSEMBLY, AND METHOD OF MANUFACTURING CABLE ASSEMBLY

CROSS-REFERENCE TO RELATED APPLICATION

The present application claims priority from Japanese Patent Application No. 2012-261954 filed on Nov. 30, 2012, the content of which is hereby incorporated by reference into this application.

TECHNICAL FIELD OF THE INVENTION

The present invention relates to a cable connector provided with a pair of signal line conductors and electrically connected with a cable for differential signal transmission which transmits differential signals whose phases are inverted to each other by an angle of 180°, relates to a cable assembly provided with the cable for differential signal transmission and the cable connector, and relates to a method of manufacturing the cable assembly.

BACKGROUND OF THE INVENTION

Conventionally, a differential interface standard such as LVDS (Low Voltage Differential Signal) is adopted in a device such as a server, a rooter, and a storage product, which handles a high-rate digital signal of several Gbit/s or higher, and differential signals are transmitted by using a cable for differential signal transmission between respective devices or respective circuit boards inside the device. The differential signals have such a feature that exogenous-noise immunity is high as reducing a voltage of a system power supply.

The cable for differential signal transmission is provided with a pair of signal line conductors, and a plus-side (positive) signal and a minus-side (negative) signal whose phases are inverted to each other by an angle of 180° are transmitted to the respective signal line conductors. And, a potential difference between these two signals (the plus-side signal and the minus-side signal) becomes a signal level, and the signal level is recognized on a reception side as, for example, "High" if the potential difference is positive and "Low" if the potential difference is negative.

As a technique which discloses a cable for differential signal transmission for transmitting such differential signals, a technique described in, for example, Japanese Patent Application Laid-Open Publication No. 2012-099434 (FIGS. 1 and 2, Patent Document 1) is known. In the technique described in the Patent Document 1, a pair of signal line conductors arranged in parallel to each other at a predetermined interval are provided, and these respective signal line conductors are covered with an insulator. That is, the respective signal line conductors are held in parallel to each other at the predetermined interval by the insulator. Further, periphery of the insulator is covered with a sheet-shaped outer conductor, and besides, periphery of the outer conductor is covered with a sheath (protective outer coat).

And, by sequentially stripping one end side of the cable for differential signal transmission in tiers, portions of the respective signal line conductors and the outer conductor are exposed outside. The exposed portion of the outer conductor is connected with a metallic shield connection terminal by swaging. The shield connection terminal is provided with a plate-shaped metal and a solder connection pin formed integrally with the plate-shaped metal, and the plate-shaped metal is plastically deformed so as to be along with the shape of the outer conductor in the swaging. In this manner, the outer conductor and the shield connection terminal are electrically connected to each other, so that the outer conductor can be electrically connected to a ground pad of a circuit board via the shield connection terminal (the plate-shaped metal and the solder connection pin).

SUMMARY OF THE INVENTION

In the technique described in the above-described Patent Document 1, for the direct connection of the outer conductor to the ground pad by soldering, heat (about 350° C.) at a tip of a soldering bit used for the soldering-connection work is not in contact with the outer conductor, and therefore, it can be suppressed that the insulator is deformed or melted by the heat at the tip of the soldering bit. However, since the shield connection terminal is swaged so as to be along with the shape of the outer conductor, the insulator inside the outer conductor is elastically deformed by a swaging force in some cases, which results in occurrence of a problem in manufacture such as change of a distance between the respective signal line conductors inside the insulator. As a result, a problem of variation in electric characteristics among the cables for differential signal transmission may occur for each product.

A preferred aim of the present invention is to provide a cable connector, a cable assembly, and a method of manufacturing the cable assembly, whose electric characteristics are stabilized by suppressing elastic deformation of a cable for differential signal transmission and which is easily connectable by reducing the number of parts.

A cable connector of the present invention has a feature of a cable connector which is electrically connected with a cable for differential signal transmission including: a pair of signal line conductors; an insulator provided in peripheries of the respective signal line conductors; and an outer conductor provided in periphery of the insulator, and the cable connector includes: a connector board made of an insulating material; a first ground contact and a second ground contact which are provided in the connector board and are electrically connected with the outer conductor; a pair of signal line contacts which are provided between the respective ground contacts in the connector board through a space and are electrically connected with the respective signal line conductors; and a first arm portion and a second arm portion which are provided integrally with end portions of the respective ground contacts protruded from a side wall portion of the connector board, which mutually extend toward the respective signal line contacts, and which hold the outer conductor under a state that the respective signal line conductors are arranged in the respective signal line contacts.

The cable connector of the present invention has features that at least either one of the respective arm portions is elastically deformed, and that a dimension in a distance between the respective arm portions is smaller than a dimension in a thickness of the outer conductor.

The cable connector of the present invention has a feature that the respective signal line conductors are pressed onto the respective signal line contacts by elastic force of the arm portions.

The cable connector of the present invention has a feature that the respective ground contacts are alternately aligned in the connector board so that the respective ground contacts positioned on both sides therein are formed in an L shape, and besides, so that the first ground contact and the second ground contact positioned between the respective ground contacts formed in the L shape are formed integrally with each other in a T shape.

The cable connector of the present invention has a feature that a dimension in a length of at least either one of the respective arm portions is set to a dimension in a length which extends beyond a center portion of the cable for differential signal transmission.

The cable connector of the present invention has a feature that a holding reinforcement portion extending in a longitudinal direction of the cable for differential signal transmission is provided integrally with the respective arm portions.

The cable connector of the present invention has a feature that peripheries of the respective arm portions are solidified by an insulating material under a state that the outer conductor is held by the respective arm portions.

The cable connector of the present invention has a feature that a tape having conductive property is wound in peripheries of the respective arm portions and the outer conductor.

A cable assembly of the present invention is a cable assembly including a cable for differential signal transmission and a cable connector which is electrically connected with the cable for differential signal transmission, the cable for differential signal transmission includes: a pair of signal line conductors; an insulator provided in peripheries of the respective signal line conductors; and an outer conductor provided in periphery of the insulator, and the cable connector includes: a connector board made of an insulating material; a first ground contact and a second ground contact which are provided in the connector board and are electrically connected with the outer conductor; a pair of signal line contacts which are provided between the respective ground contacts in the connector board through a space and are electrically connected with the respective signal line conductors; and a first arm portion and a second arm portion which are provided integrally with end portions of the respective ground contacts protruded from a side wall portion of the connector board, which mutually extend toward the respective signal line contacts, and which hold the outer conductor under a state that the respective signal line conductors are arranged in the respective signal line contacts.

The cable assembly of the present invention has features that at least either one of the respective arm portions is elastically deformed, and that a dimension in a distance between the respective arm portions is smaller than a dimension in a thickness of the outer conductor.

The cable assembly of the present invention has a feature that the respective signal line conductors are pressed onto the respective signal line contacts by elastic force of the arm portions.

The cable assembly of the present invention has a feature that the respective ground contacts are alternately aligned on the connector board so that the respective ground contacts positioned on both sides thereon are formed in an L shape, and besides, so that the first ground contact and the second ground contact positioned between the respective ground contacts formed in the L shape are formed integrally with each other in a T shape.

The cable assembly of the present invention has a feature that a dimension in a length of at least either one of the respective arm portions is set to a dimension in a length which extends beyond a center portion of the cable for differential signal transmission.

The cable assembly of the present invention has a feature that a holding reinforcement portion extending in a longitudinal direction of the cable for differential signal transmission is provided integrally with the respective arm portions.

The cable assembly of the present invention has a feature that peripheries of the respective arm portions are solidified by an insulating material under a state that the outer conductor is held by the respective arm portions.

The cable assembly of the present invention has a feature that a tape having conductive property is wound in peripheries of the respective arm portions and the outer conductor.

A method of manufacturing a cable assembly of the present invention has a feature of steps including: a cable preparing step of preparing a cable for differential signal transmission including a pair of signal line conductors, an insulator provided in peripheries of the respective signal line conductors, and an outer conductor provided in periphery of the insulator; a cable-connector preparing step of preparing a cable connector including a connector board made of an insulating material, a first ground contact and a second ground contact which are provided in the connector board and are electrically connected with the outer conductor, a pair of signal line contacts which are provided between the respective ground contacts in the connector board through a space and are electrically connected with the respective signal line conductors, and a first arm portion and a second arm portion which are provided integrally with end portions of the respective ground contacts protruded from a side wall portion of the connector board and which mutually extend toward the respective signal line contacts; and a connecting step of electrically connecting between the respective signal line conductors and the respective signal line contacts under a state that the respective signal line conductors are arranged in the respective signal line contacts, and besides, the outer conductor is arranged between the respective arm portions so that the outer conductor is held by the respective arm portions.

The method of manufacturing the cable assembly of the present invention has a feature that the connecting step is followed by a mold forming step of solidifying the peripheries of the respective arm portions by an insulating material.

According to the present invention, the first ground contact and the second ground contact are provided on the connector board, the respective signal line contacts are provided thereon between the respective ground contacts through a space, the first arm portion and the second arm portion are provided so as to be integrally with end portions of the respective ground contacts protruded from a side wall portion of the connector board and so as to be mutually extend toward the respective signal line contacts, and the outer conductor is held by the respective arm portions under a state that the respective signal line conductors are arranged in the respective signal line contacts. In this manner, it is not required to swage a shield connection terminal so as to be along with a shape of the outer conductor as conventional, so that the electric characteristics can be stabilized by suppressing the elastic deformation of the cable for differential signal transmission. Also, the conventional shield connection terminal is not required, and therefore, the connection work between the outer conductor and the respective ground contacts can be simplified as reducing the number of parts. Further, the soldering connection work for electrically connecting the outer conductor with the respective ground contacts is not required, either, and therefore, thermal deformation of the cable for differential signal transmission due to exposure to a high temperature is prevented.

BRIEF DESCRIPTIONS OF THE DRAWINGS

DESCRIPTIONS OF THE PREFERRED EMBODIMENTS

Hereinafter, a first embodiment of the present invention will be described in detail with reference to the drawings.

Figure 1:
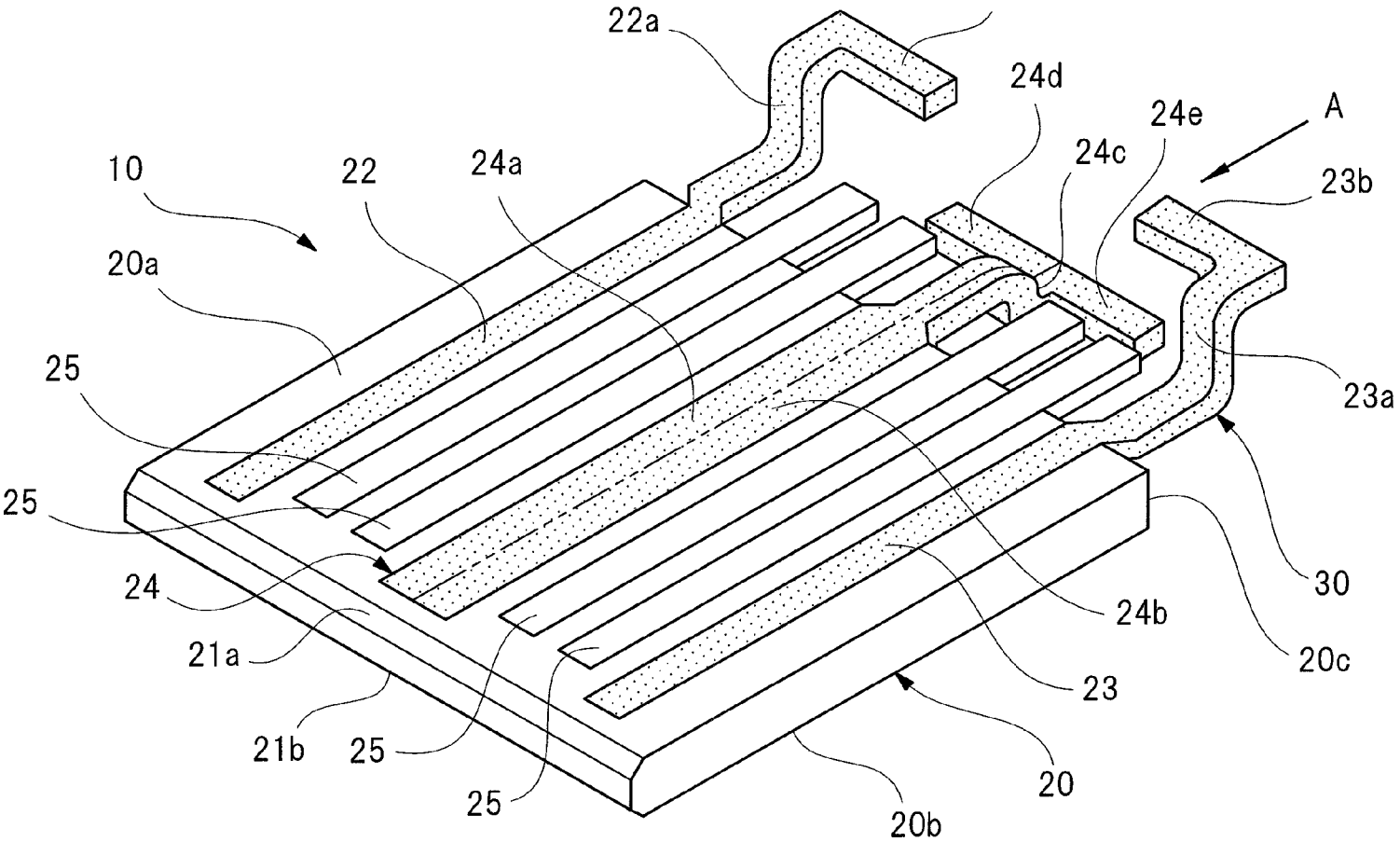
FIG. 1 is a perspective view illustrating a cable connector according to a first embodiment.
Figure 2:
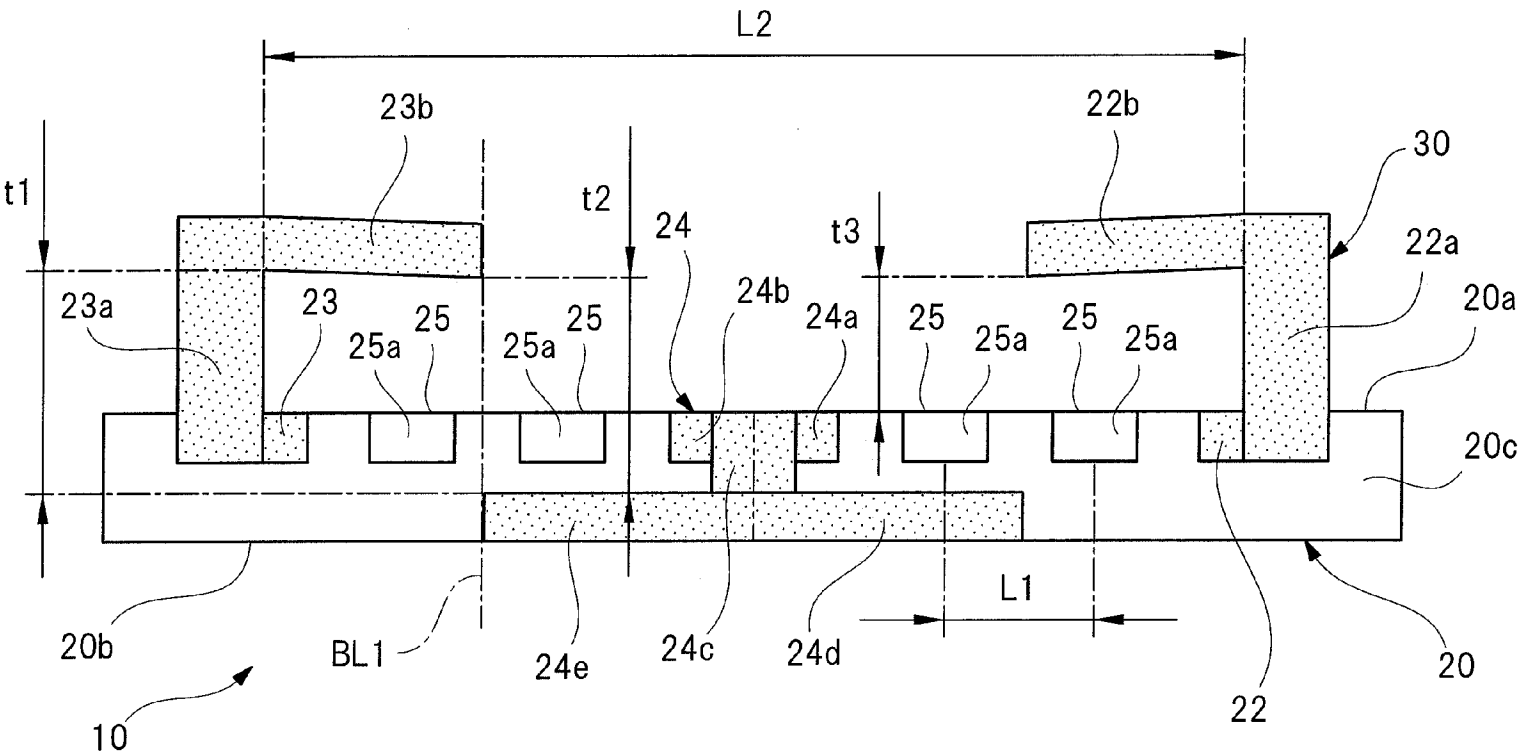
FIG. 2 is a side view on an arrow "A" in FIG. 1.
Figure 3A:
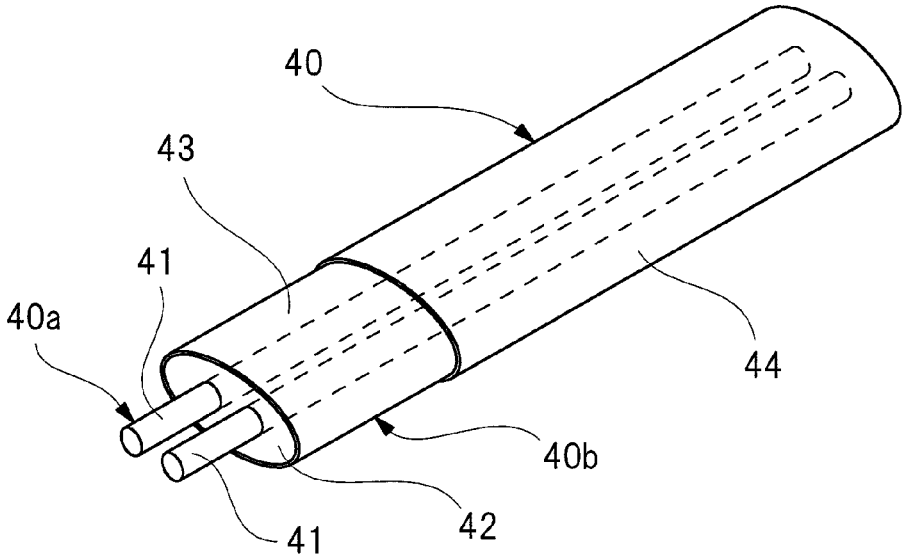
FIG. 3A is a perspective view of a cable for differential signal transmission.
Figure 3B:
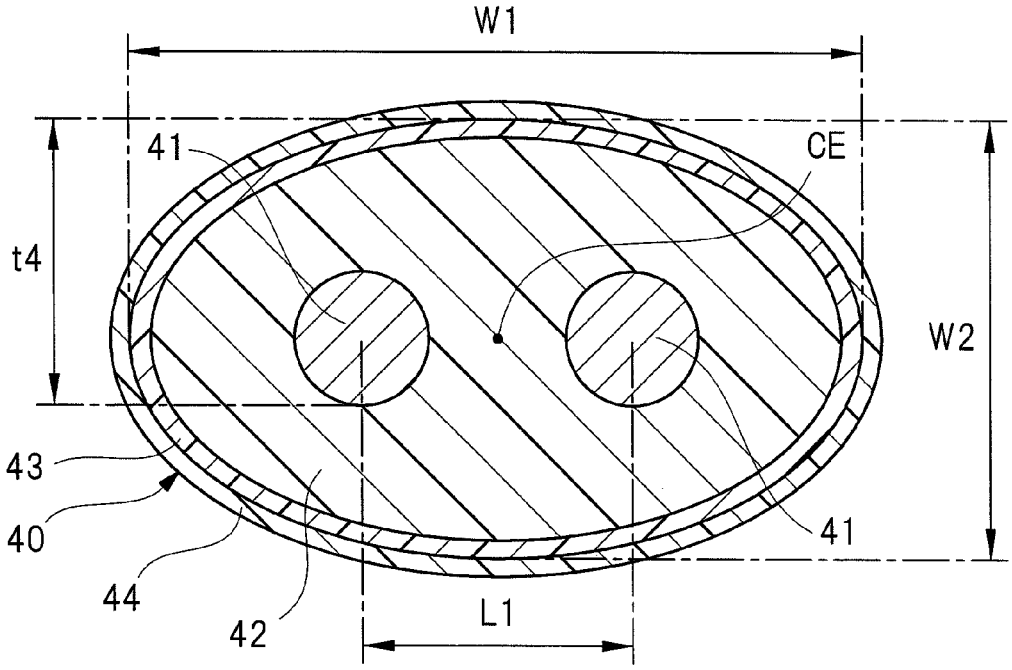
FIG. 3B is a cross-sectional view of the cable for differential signal transmission.
Figure 4A:
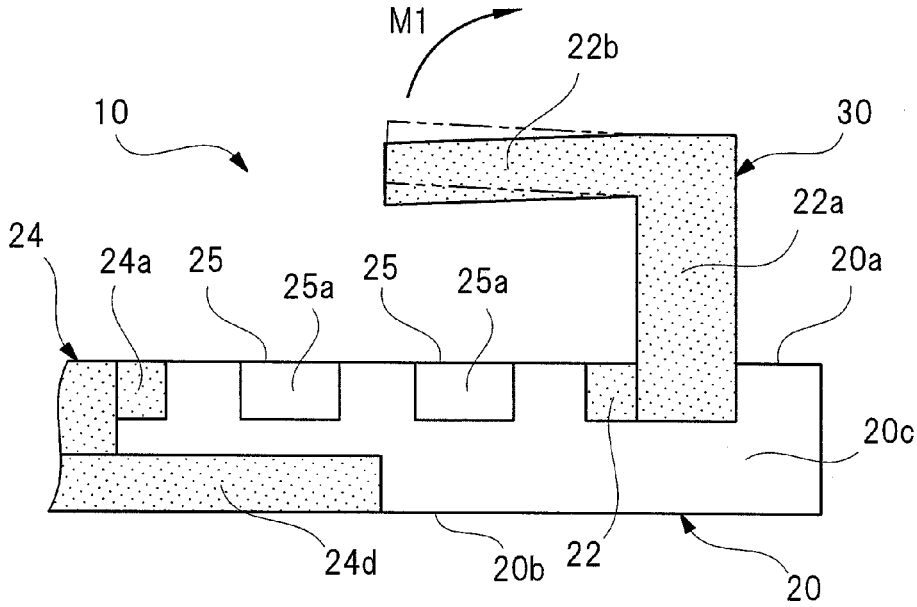
FIG. 4A is a partially-enlarged view for explaining a manufacturing procedure (assembling procedure) of a cable assembly.
Figure 4B:
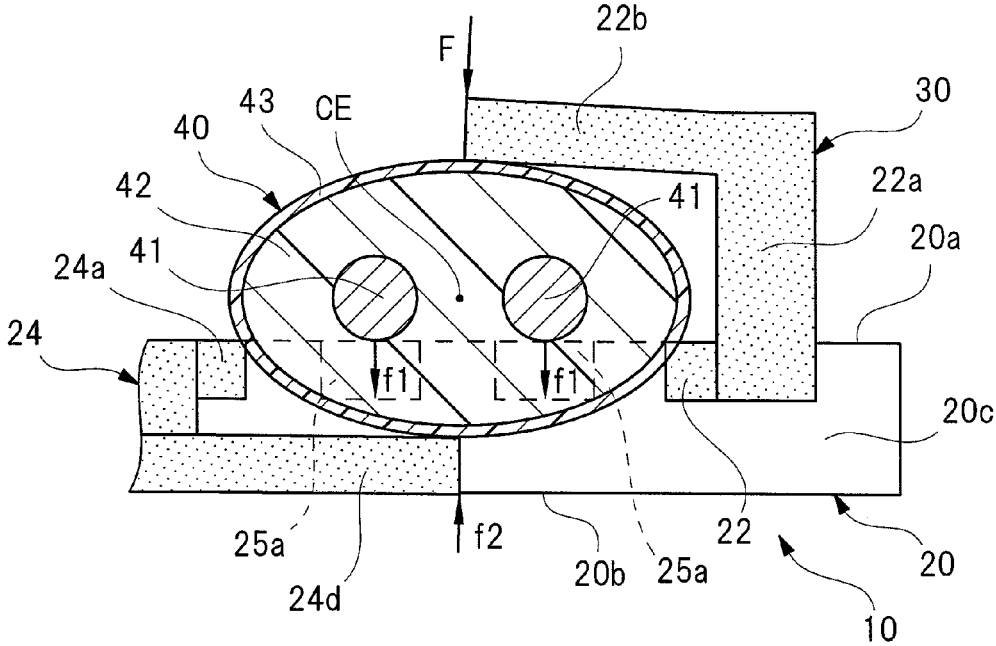
FIG. 4B is a partially-enlarged view for explaining a manufacturing procedure (assembling procedure) of a cable assembly.
Figure 5:
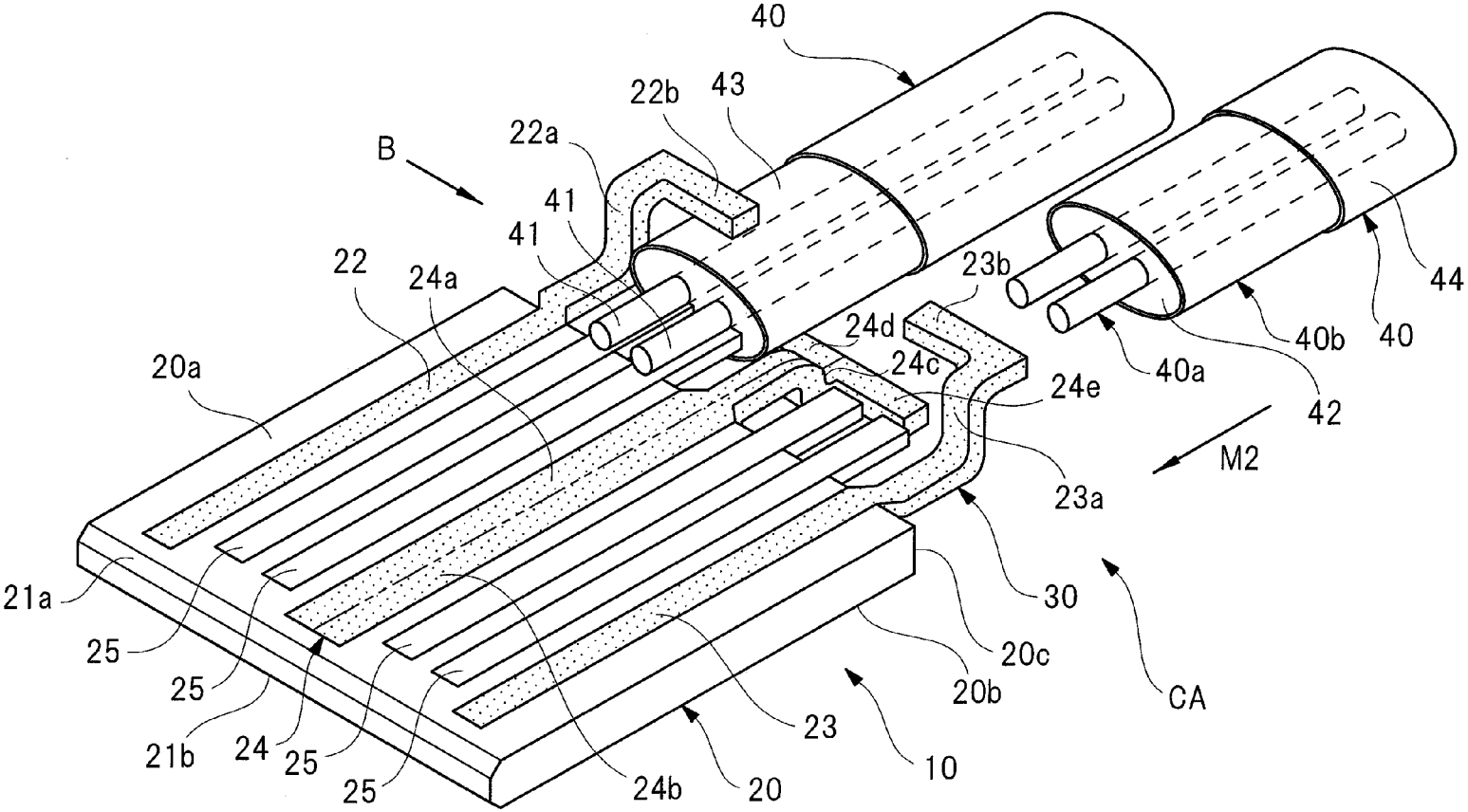
FIG. 5 is a perspective view for explaining the manufacturing procedure of the cable assembly.
Figure 6:
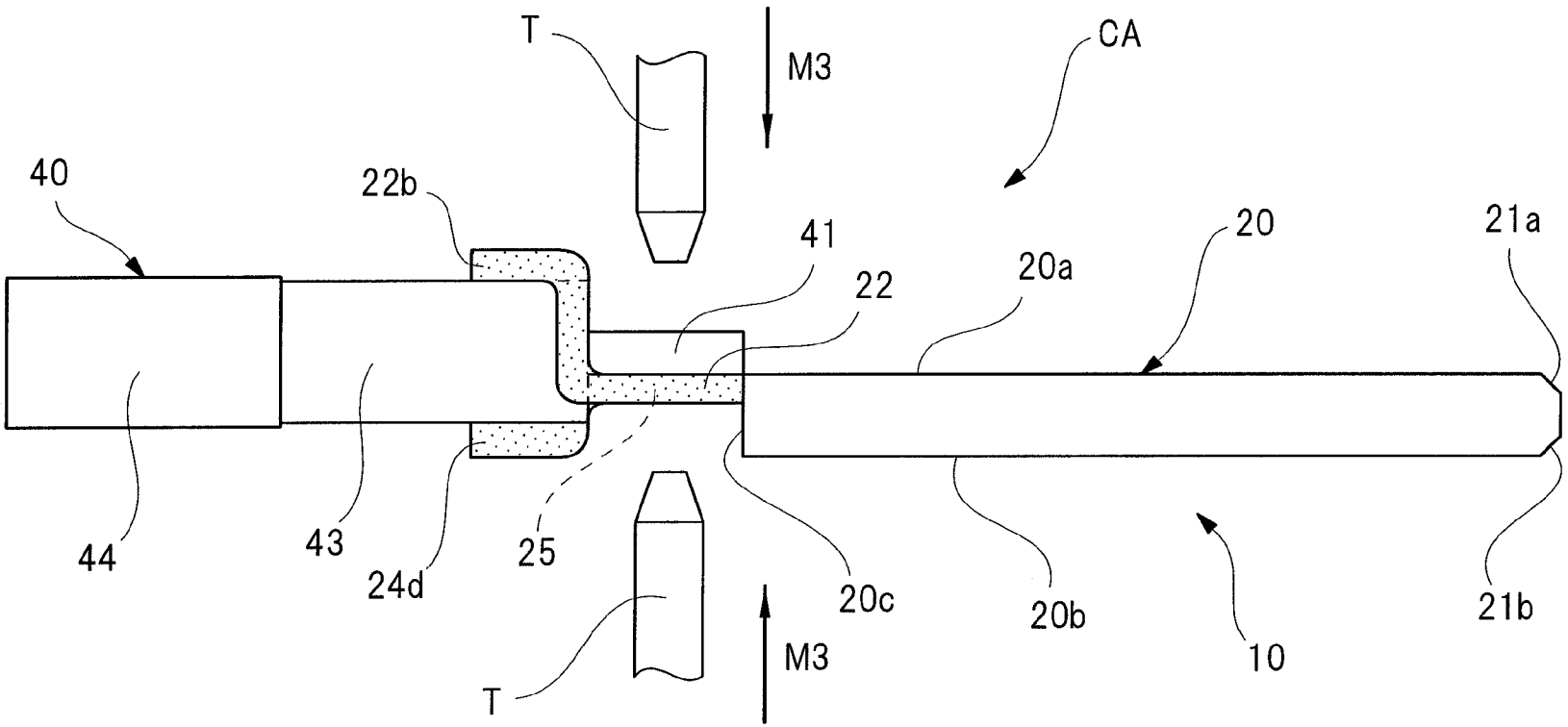
FIG. 6 is a side view on an arrow "B" in FIG. 5.

FIG. 1 is a perspective view illustrating a cable connector according to the first embodiment, FIG. 2 is a side view on an arrow "A" in FIG. 1, FIG. 3A is a perspective view of a cable for differential signal transmission, FIG. 3B is a cross-sectional view of the cable for differential signal transmission, FIGS. 4A and 4B are partially-enlarged views for explaining a manufacturing procedure (assembling procedure) of a cable assembly, FIG. 5 is a perspective view for explaining the manufacturing procedure of the cable assembly, and FIG. 6 is a side view on an arrow "B" in FIG. 5.

As illustrated in FIGS. 1 and 2, a cable connector 10 is provided with a connector main body (connector board) 20 and a cable connection portion 30. The connector main body 20 is configured to be inserted into, for example, a slot (socket) provided in a backplane product (not illustrated), and a plurality of cables for differential signal transmission 40 (see FIG. 3) are electrically connected to the cable connection portion 30. Note that two cables for differential signal transmission 40 are electrically connected to the illustrated cable connector 10.

The connector main body 20 is made of an insulating material such as epoxy resin and formed in a plate shape, and has a front-side surface 20*a* and a rear-side surface 20*b*. On tip-end sides of the connector main body 20 in a direction of the insertion into the socket, a pair of taper surfaces 21*a* and 21*b* are formed so as to correspond to the front-side surface 20*a* and the rear-side surface 20*b*. The taper surfaces 21*a* and 21*b* are obtained by forming the tip-end sides of the connector main body 20 in the insertion direction in a tapered shape so that the insertion of the connector main body 20 into the socket is guided.

In the connector main body 20, a pair of L-shaped ground contacts 22 and 23, one T-shaped ground contact 24, and four signal line contacts 25 are provided so as to extend from the respective taper surfaces 21*a* and 21*b* sides toward an opposite side to the respective taper surfaces 21*a* and 21*b* sides. Here, in order to easily distinguish the respective ground contacts 22 to 24 from the respective signal line contacts 25, hatching is added to the respective ground contacts 22 to 24 as illustrated.

All of the respective ground contacts 22 to 24 and the respective signal line contact 25 are formed in a bar shape by pressing a steel plate made of brass having an excellent conductive property or others, and are provided so as to extend and bridge between both of the connector main body 20 and the cable connection portion 30. The respective ground contacts 22 to 24 and the respective signal line contact 25 are embedded so as to be closer to the front-side surface 20*a* in a direction of a plate thickness of the connector main body 20 by insert molding, and a part (front-surface part) of the respective ground contacts 22 to 24 and the respective signal line contact 25 is exposed outside from the front-side surface 20*a*.

The respective ground contacts 22 to 24 and the respective signal line contact 25 are embedded in the connector main body 20 at predetermined intervals from each other, so that short circuit does not occur between them. All of the respective signal line contact 25 are formed in a straight bar shape, and, while one part of about 4/5 in a length of each signal line contact 25 is embedded in the connector main body 20, the other part of about 1/5 in the length thereof is protruded from a side wall portion 20*c* of the connector main body 20 so as to form a cable connection portion 30.

Here, when the cable for differential signal transmission 40 is connected to the connector main body 20, an end portion of the insulator 42 (see FIG. 3) forming the cable for differential signal transmission 40 abuts on each protruding end 25*a* of the respective signal line contacts 25. In this manner, the cable for differential signal transmission 40 can be positioned with respect to the connector main body 20 with high accuracy.

Each two signal line contacts 25 are arranged between the L-shaped ground contact 22 and the T-shaped ground contact 24 and between the T-shaped ground contact 24 and the L-shaped ground contact 23. And, the respective signal line conductors 41 (see FIGS. 3A and 3B) of the pair of cables for differential signal transmission 40 are electrically connected to each two signal line contacts 25.

As illustrated in FIG. 2, the pair of L-shaped ground contacts 22 and 23 are arranged on both sides of the connector main body 20 in the direction of the alignment of the respective ground contacts 22 to 24 and the respective signal line contacts 25. Further, the respective L-shaped ground contacts 22 and 23 are formed so as to have the L shapes by pressing work or others in viewing the contactor main body 20 from the front-side surface 20*a*. On the other hand, the T-shaped ground contact 24 arranged to be sandwiched between the respective L-shaped ground contacts 22 and 23 is formed so as to have the T shape by pressing work or others in viewing the contactor main body 20 from the front-side surface 20*a*.

One L-shaped ground contact 22 is provided so as to correspond to one cable for differential signal transmission 40, and configures a first ground contact in the present invention. Further, the other L-shaped ground contact 23 is provided so as to correspond to the other cable for differential signal transmission 40, and configures a second ground contact in the present invention.

The T-shaped ground contact 24 is formed as a common ground contact corresponding to both of the pair of cables for differential signal transmission 40. That is, the T-shaped ground contact 24 can be divided into a first portion 24*a* corresponding to one cable for differential signal transmission 40 and a second portion 24*b* corresponding to the other cable for differential signal transmission 40 on a two-dotted chain line in the drawing as a boundary portion.

And, the first portion 24*a* of the T-shaped ground contact 24 configures a second ground contact in the present invention corresponding to one cable for differential signal transmission 40. Further, the second portion 24*b* of the T-shaped ground contact 24 configures a first ground contact in the present invention corresponding to the other cable for differential signal transmission 40. That is, the T-shaped ground contact 24 is formed by integrally forming the first ground contact and the second ground contact in the present invention with each other.

As descried above, by aligning the respective L-shaped ground contacts 22 and 23 and the T-shaped ground contact 24 as illustrated in the drawing, the first ground contact and the second ground contact in the present invention are alternately aligned in the connector main body 20.

While one part of about ⅔ in a length of each of the respective ground contacts 22 to 24 is embedded in the connector main body 20, the other part of about ⅓ in the length thereof is protruded from a side wall portion 20*c* of the connector main body 20 so as to form a cable connection portion 30. The portions of the respective ground contacts 22 and 23 which form the cable connection portion 30, that is, protruding portions 22*a* and 23*a* protruded from the side wall portion 20*c* are formed to be bent at the tip-end sides so as to protrude toward the front-side surface 20*a* of the connector main body 20. And, at end portions of the respective protruding portions 22*a* and 23*a*, front-side arm portions 22*b* and 23*b* mutually extending toward the respective signal line contacts 25 are provided integrally therewith.

The respective front-side arm portions 22*b* and 23*b* are formed so as to be elastically deformed. In this manner, while the respective signal line conductors 41 of the cable for differential signal transmission 40 are pressed onto the respective signal line contacts 25, the outer conductor 43 (see FIGS. 3A and 3B) of the cable for differential signal transmission 40 is pressed onto respective rear-side arm portions 24*d* and 24*e* of the T-shaped ground contact 24.

Note that the front-side arm portion 22*b* of the L-shaped ground contact 22 configures the first arm portion in the present invention corresponding to one cable for differential signal transmission 40. Further, the front-side arm portion 23*b* of the L-shaped ground contact 23 configures the second arm portion in the present invention corresponding to the other cable for differential signal transmission 40.

The portion of the T-shaped ground contact 24 which form the cable connection portion 30, that is, a protruding portion 24*c* protruded from the side wall portion 20*c* is formed to be bent at the tip-end side so as to protrude toward the rear-side surface 20*b* of the connector main body 20. And, at an end portion of the protruding portion 24*c*, a pair of rear-side arm portions 24*d* and 24*e* extending toward the respective signal line contacts 25 are provided integrally therewith so as to correspond to one and the other cables for differential signal transmission 40, respectively.

Here, the respective rear-side arm portions 24*d* and 24*e* are also formed so as to be elastically deformed by a weak force. More specifically, the elastic forces of the respective front-side arm portions 22*b* and 23*b* are larger than the elastic forces of the respective rear-side arm portions 24*d* and 24*e*. In this manner, the respective signal line conductors 41 can be securely pressed onto the respective signal line contacts 25.

Note that the rear-side arm portion 24*d* of the T-shaped ground contact 24 configures a second arm portion in the present invention corresponding to one cable for differential signal transmission 40. Further, the rear-side arm portion 24*e* of the T-shaped ground contact configures a first arm portion in the present invention corresponding to the other cable for differential signal transmission 40.

The front-side arm portion 22*b* and the rear-side arm portion 24*d* move in cooperation with each other so as to hold the outer conductor 43 of one cable for differential signal transmission 40, and are electrically connected to the outer conductor 43. Further, the rear-side arm portion 24*e* and the front-side arm portion 23*b* move in cooperation with each other so as to hold the outer conductor 43 of the other cable for differential signal transmission 40, and are electrically connected to the outer conductor 43.

As illustrated in FIG. 3, the cable for differential signal transmission 40 is provided with the pair of signal line conductors 41. While a plus-side (positive) signal as a differential signal is transmitted to either one of the respective signal line conductors 41, a minus-side (negative) signal as a differential signal is transmitted to the other of the respective signal line conductors 41. Each signal line conductor 41 is formed of, for example, annealed (soft) copper wire whose surface has been subjected to tin-plating treatment (which is a tinned annealed copper wire), and each signal line conductor 41 is covered with an insulator 42.

The insulator 42 is made of, for example, foamed polyethylene in order to provide flexibility to the cable for differential signal transmission 40, a horizontal cross-sectional shape thereof is formed in a substantial oval shape. The insulator 42 holds the respective signal line conductors 41 so as to arrange them at a predetermined interval, and the insulator 42 is provided in the peripheries of the respective signal line conductors 41 so as to have thicknesses which are substantially equal to each other.

However, the horizontal cross-sectional shape of the insulator 42 is not limited to the substantial oval shape as illustrated, and may be, for example, a substantial circular shape obtained by individually coating each of the signal line conductors 41. Further, the horizontal cross-sectional shape of the insulator 42 may be a shape which is substantially equal to, for example, a track of an athletics track field formed of a pair of parallel lines having the same length and a pair of semicircular shapes.

An outer conductor 43 for suppressing influence of the exogenous noises is provided in the periphery of the insulator 42. The outer conductor 43 is made of, for example, a sheet-shaped copper foil, and covers most of the insulator 42 except for end portions in the longitudinal direction of the insulator 42. However, the outer conductor 43 is not limited to the copper foil, and may be another metal foil, and further, may be a braided sheet obtained by braiding a metal thin wire such as an annealed copper wire.

A sheath 44 serving as a protective outer coat for protecting the cable for differential signal transmission 40 is provided in the periphery of the outer conductor 43, and the sheath 44 covers most of the outer conductor 43 except for end portions of the outer conductor 43 in the longitudinal direction thereof. Note that the sheath 44 is made of, for example, heat resistant polyvinyl chloride (PVC). Further, the cable for differential signal transmission 40 does not include a drain line.

As illustrated in FIG. 3, a signal-line conductor exposure portion 40*a* from which the respective signal line conductors 41 are exposed outside and an outer conductor exposure portion 40*b* from which the outer conductor 43 is exposed outside by sequentially stripping them in tiers in the longitudinal direction are provided at the end portion of the cable for differential signal transmission 40. That is, the signal-line conductor exposure portion 40*a* and the outer conductor exposure portion 40*b* are aligned in this order from the end portion of the cable for differential signal transmission 40.

Next, based on FIGS. 2 and 3B, dimensions of various portions of the cable connector 10 and the cable for differential signal transmission 40 will be described in detail.

A length "L1" of a line which connects between center portions of the respective signal line contacts 25 is set to be equal to a length "L1" of a line which connects between center portions of the respective signal line conductors 41 (L1=L1 ). In this manner, the respective signal line conductors 41 can be electrically and securely in contact with the respective signal line contacts 25.

Here, if both lengths are made different from each other, such a problem that one signal line conductor 41 and one signal line contact 25 cannot be connected to each other due to a position shift between the both of them may occur.

A separation distance "L2" between the respective protruding portions 22*a* and 23*a* forming the respective L-shaped ground contacts 22 and 23 is set to be larger than twice a dimension in a length of a long axis of the outer conductor 43 forming the cable for differential signal transmission 40 (which is a dimension in a width) "W1" (L2>2×W1). In this manner, the outer conductors 43 of the cables for differential signal transmission 40 can be arranged between the protruding portions 22*a* and 24*c* and between the protruding portions 24*c* and 23*a* with a margin without being in contact with each other.

A distance (distant dimension) "t1" between base portions of the respective front-side arm portions 22*b* and 23*b* forming the respective L-shaped ground contacts 22 and 23 and the respective rear-side arm portions 24*d* and 24*e* of the T-shaped ground contact 24 is set to a distance slightly longer than a distance "t2" between tip portions of the respective front-side arm portions 22*b* and 23*b* and the respective rear-side arm portions 24*d* and 24*e* (t1>t2). Further, a dimension in a length of a short axis of the outer conductor 43 (which is a dimension in a thickness) "W2" is set to a dimension in a length slightly longer than the distance t1 (W2 >t1).

In this manner, the outer conductor 43 is clamped by the tip portions of the respective front-side arm portions 22*b* and 23*b* and the tip portions of the respective rear-side arm portions 24*d* and 24*e*, and, as a result, the cable for differential signal transmission 40 can be clamped by the respective front-side arm portions 22*b* and 23*b* and the respective rear-side arm portions 24*d* and 24*e*. At this time, a clamping force (holding force) generated by the respective front-side arm portions 22*b* and 23*b* and the respective rear-side arm portions 24*d* and 24*e* is obtained by setting the dimension in the thickness W2 of the outer conductor 43 to be slightly longer than the distance t1, and therefore, the cable for differential signal transmission 40 is not elastically deformed as large as the electric characteristics are adversely affected. On the other hand, the respective front-side arm portions 22*b* and 23*b* and the respective rear-side arm portions 24*d* and 24*e* can be electrically connected securely to the outer conductor 43 by the clamping force.

A distance "t3" between the tip portions of the respective front-side arm portions 22*b* and 23*b* forming the respective L-shaped ground contacts 22 and 23 and the front-side surface 20*a* (respective signal line contacts 25) of the connector main body 20 is set to a dimension slightly smaller than a distance "t4" between lower portions of the respective signal line conductors 41 and an upper portion of the outer conductor 43 in the thickness direction of the cable for differential signal transmission 40 (t3<t4). In this manner, the respective signal line conductors 41 can be pressed onto the respective signal line contacts 25 under the state that the cable for differential signal transmission 40 is held by the respective front-side arm portions 22*b* and 23*b* and the respective rear-side arm portions 24*d* and 24*e*, so that both of them can be electrically connected securely to each other.

Here, the tip portions of the respective front-side arm portions 22*b* and 23*b* and the tip portions of the respective rear-side arm portions 24*d* and 24*e* are arranged at the substantial same position illustrated by a line "BL1". And, the line BL1 is arranged on a center portion "CE" of the cable for differential signal transmission 40 under the state that the cable for differential signal transmission 40 is held by the respective front-side arm portions 22*b* and 23*b* and the respective rear-side arm portions 24*d* and 24*e*. Therefore, the respective front-side arm portions 22*b* and 23*b* and the respective rear-side arm portions 24*d* and 24*e* can stably hold the cable for differential signal transmission 40.

Next, a method of connecting between the cable connector 10 and the cable for differential signal transmission 40 formed as described above, that is, a method of manufacturing a cable assembly "CA" (see FIG. 5) will be described in detail with reference to the drawings.

[Cable Preparing Step]

First, the cable for differential signal transmission 40 (see FIG. 3) including: the respective signal line conductors 41; the insulator 42; the outer conductor 43; and the sheath 44, is prepared. And, the signal-line conductor exposure portion 40*a* and the outer conductor exposure portion 40*b* are formed by sequentially stripping the end portion of the prepared cable for differential signal transmission 40 in tiers as illustrated in FIG. 3. In this manner, the cable preparing step is completed.

[Cable Connector Preparing Step]

Next, the above-described cable connector 10 (see FIG. 1) to which two cables for differential signal transmission 40 are electrically connectable is prepared. In this manner, the cable connector preparing step is completed. Here, cable connectors having a plurality of specifications (for four connection or others) is prepared in accordance with the connection number of the cable for differential signal transmission 40, and can be appropriately selected in accordance with the required specification. Note that the cable connector for four connection will be described later as the specification of other cable connector.

Here, since the cable for differential signal transmission 40 and the cable connector 10 are prepared independently from each other in the [Cable Preparing Step] and the [Cable Connector Preparing Step], an order of these steps may be changed. That is, the [Cable Connector Preparing Step] may be performed first, and then, the [Cable Preparing Step] may be performed.

[Connecting Step]

Next, as illustrated in FIG. 4A, the distances t2 and t3 (see FIG. 2) are made longer by elastically deforming the front-side arm portion 22*b* of the L-shaped ground contact 22 in a direction of an arrow "M1". That is, spaces between the front-side arm portion 22*b* and the rear-side arm portion 24*d* and between the front-side arm portion 22*b* and the front-side surface 20*a* are expanded. And, as illustrated by arrow "M2" in FIG. 5, the cable for differential signal transmission 40 approaches the cable connection portion 30 under this state so that the respective signal line conductors 41 (signal line conductor exposure portions 40*a*) are arranged on the respective signal line contacts 25, and besides, the outer conductor 43 (outer conductor exposure portion 40*b*) is arranged between the front-side arm portion 22*b* and the rear-side arm portion 24*d*. Here, by making the end portion of the insulator 42 abut on the respective protruding portions 25*a* of the respective signal line contacts 25, the cable for differential signal transmission 40 is positioned with respect to the cable connector 10.

Then, the state that the front-side arm portion 22*b* is elastically deformed is released. In this manner, as illustrated in FIG. 4B, the elastic force "F" of the front-side arm portion 22*b* is loaded on the outer conductor 43. In this manner, the cable for differential signal transmission 40 is fixed to the cable connector 10, so that the front-side arm portion 22*b* and the outer conductor are electrically connected to each other. Further, the respective signal line conductors 41 are pressed onto the respective signal line contacts 25 by a pressing force "f1" (a component force of the elastic force F), so that the respective signal line conductors 41 and the respective signal line contacts 25 are electrically connected to each other. This moment provides a "temporary connected state" that the respective signal line conductors 41 and the respective signal line contacts 25 are pressed onto each other.

Here, although the rear-side arm portion 24*d* presses the outer conductor 43 toward the front-side arm portion 22*b* by a pressing force "f2" weaker than the pressing force f1, the respective signal line conductors 41 are not separated from the respective signal line contacts 25 because of the relationship of "f2<f1". On the other hand, the rear-side arm portion 24*d* is pressed onto the outer conductor 43 by the pressing force f2, and therefore, the rear-side arm portion 24*d* and the outer conductor 43 are electrically connected securely to each other.

Next, the connection between the respective signal line conductors 41 and the respective signal line contacts 25 is brought into an "actual connected state" by using an ultrasonic welder (not illustrated) under the state that the cable for differential signal transmission 40 is fixed to the cable connector 10, that is, under the state that the outer conductor 43 is held by the front-side arm portion 22*b* and the rear-side arm portion 24*d*. More specifically, as illustrated by an arrows "M3" in FIG. 6, a pair of jigs "T" configuring the ultrasonic welder are made to abut on the respective signal line conductors 41 and the respective signal line contacts 25, and the respective jigs T are vibrated with a high frequency. In this manner, the respective signal line conductors 41 and the respective signal line contacts 25 are welded and fixed to each other, so that the connecting step is completed, and the cable assembly CA is completed.

However, as the connecting means for connecting between the respective signal line conductors 41 and the respective signal line contacts 25, connecting means in which the cable connector 10 and the cable for differential signal transmission 40 are not exposed to a high temperature as seen in the above-described ultrasonic welding is desired, and another connecting means such as a low-temperature soldering can be also adopted.

Note that FIG. 4 illustrates only one cable for differential signal transmission 40 side. However, the other cable for differential signal transmission 40 side is also similarly connected.

As described in detail, according to the cable connector 10 according to the first embodiment, the respective ground contacts 22 to 24 and the respective signal line contacts 25 positioned between the respective ground contacts 22 to 24 through the space are provided in the connector main body 20. The front-side arm portions 22*b* and 23*b* and the rear-side arm portions 24*d* and 24*e* mutually extending toward the respective signal line contacts 25 are integrally provided at the end portions of the respective ground contacts 22 to 24 protruded from the side wall portion 20*c* of the connector main body 20. And, the outer conductor 43 is held by the front-side arm portions 22*b* and 23*b* and the rear-side arm portions 24*d* and 24*e* under the state that the respective signal line conductors 41 are arranged in the respective signal line contact 25.

In this manner, it is not required to swage the shield connection terminal so as to be along with the shape of the outer conductor as conventional, so that the elastic deformation of the cable for differential signal transmission 40 is suppressed, and therefore, the electric characteristics can be stabilized. Further, the conventional shield connection terminal is not required, and therefore, the connecting work between the outer conductor 43 and the respective ground contacts 22 to 24 can be simplified as reducing the number of parts. Still further, the soldering connection work for electrically connecting the outer conductor 43 to the respective ground contacts 22 to 24 is not required, either, and therefore, the thermal deformation of the cable for differential signal transmission 40 due to the exposure to the high temperature is prevented.

Still further, according to the cable connector 10 according to the first embodiment, the front-side arm portions 22*b* and 23*b* and the rear-side arm portions 24*d* and 24*e* are made elastically deformable, and the distant dimension (distance t2) between the front-side arm portion 22*b* and the rear-side arm portion 24*d* and the distant dimension (distance t2) between the front-side arm portion 23*b* and the rear-side arm portion 24*e* are set to be smaller than the dimension in the thickness W2 of the outer conductor 43. In this manner, the outer conductors 43 can be clamped to be securely held by the front-side arm portions 22*b* and 23*b* and the rear-side arm portion 24*d* and 24*e*.

Still further, according to the cable connector 10 according to the first embodiment, the respective signal line conductors 41 can be pressed onto the respective signal line contacts 25 by the elastic force F of the front-side arm portions 22*b* and 23*b*, and therefore, the respective signal line conductors 41 and the respective signal line contacts 25 can be electrically securely connected to each other.

Still further, according to the cable connector 10 according to the first embodiment, the respective ground contacts 22 to 24 are alternately aligned in the connector main body 20, and each of the ground contacts 22 and 23 positioned on both sides therein is formed in the L shape, and besides, the ground contact 24 positioned between the respective ground contacts 22 and 23 formed in the L shape is formed in the T shape by integrally forming the second portion 24*b* corresponding to the first ground contact and the first portion 24*a* corresponding to the second ground contact. In this manner, the cables for differential signal transmission 40 adjacent to each other can be arranged so as to be close to each other, and therefore, the cable assembly CA can be downsized.

Next, a second embodiment of the present invention will be described in detail with reference to the drawings. Note that the parts having the same function as that of the above-described first embodiment are denoted by the same reference symbols, and detailed explanation thereof is omitted.

Figure 7:
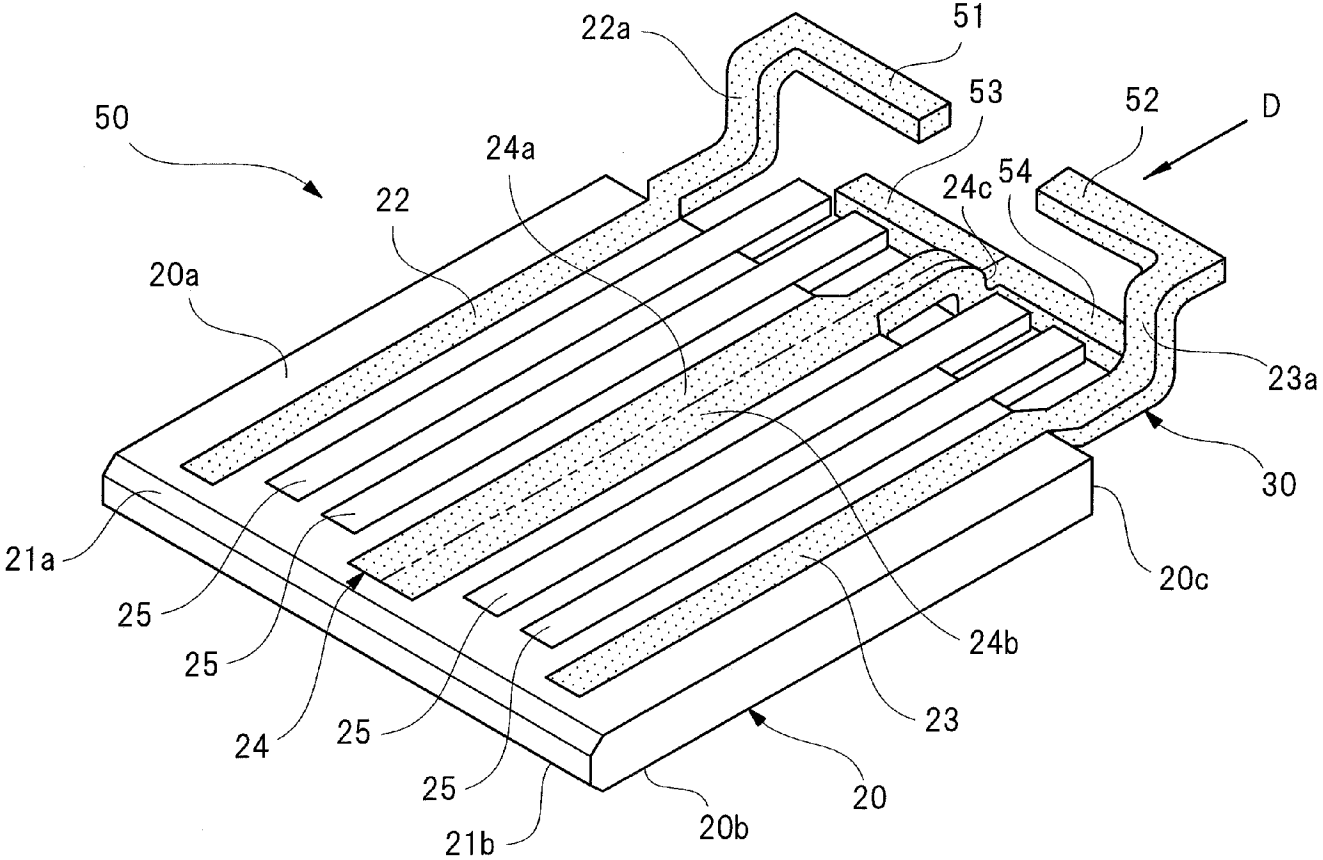
FIG. 7 is a perspective view illustrating a cable connector according to a second embodiment.
Figure 8:
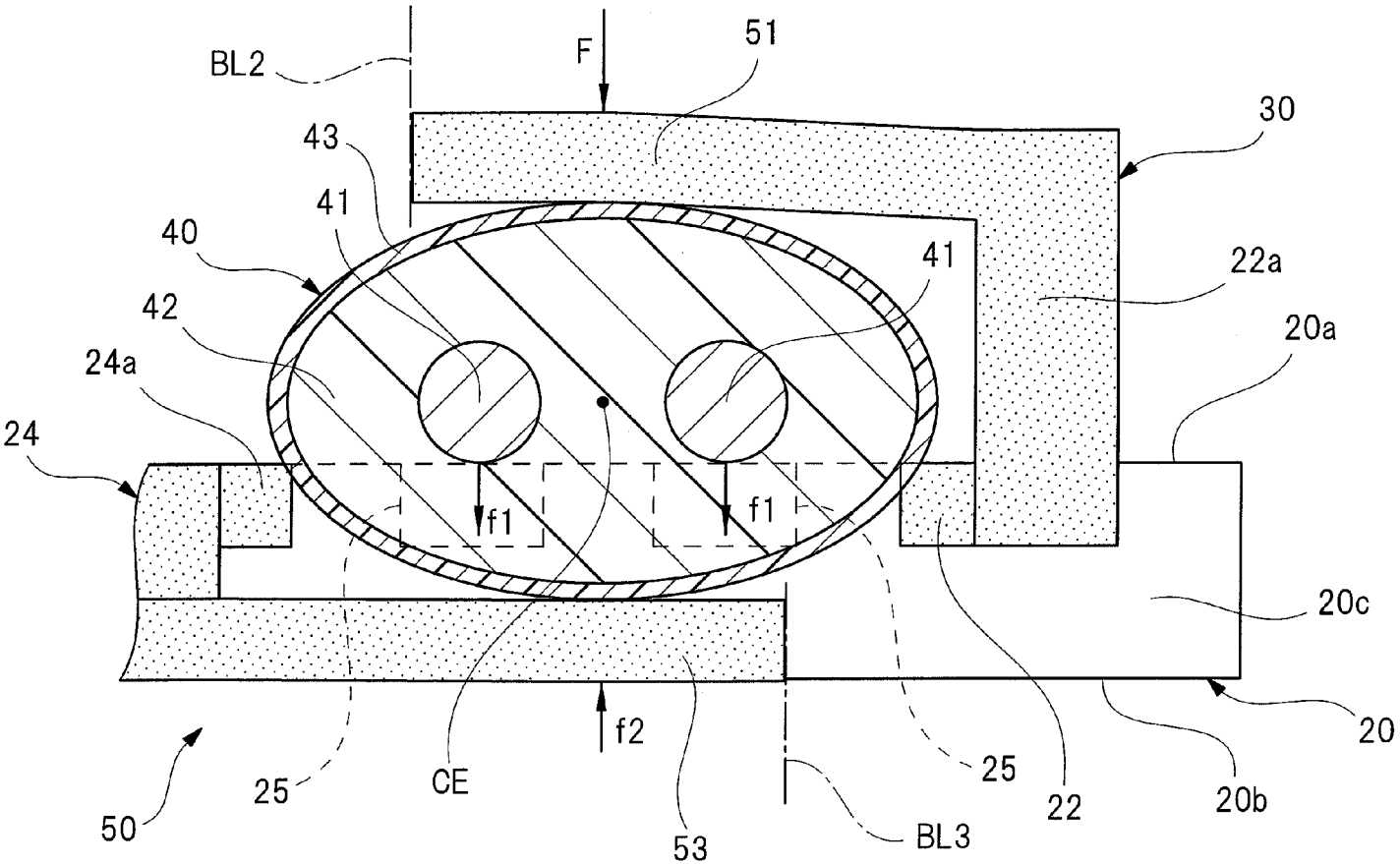
FIG. 8 is a partially-enlarged view of the cable assembly according to the second embodiment, which corresponds to FIG. 4B.

FIG. 7 is a perspective view illustrating a cable connector according to the second embodiment, and FIG. 8 is a partially-enlarged view of a cable assembly according to the second embodiment, which corresponds to FIG. 4B.

As illustrated in FIGS. 7 and 8, a cable connector 50 according to the second embodiment is different from the cable connector 10 according to the first embodiment (see FIG. 1) in only that dimensions in lengths of front-side arm portions (first and second arm portions) 51 and 52 and rear-side arm portions (second and first arm portions) 53 and 54 integrally provided with the respective ground contacts 22 to 24 are longer than those of the cable connector 10.

A dimension in the length of the front-side arm portion 51 is set so that a tip portion thereof extends beyond the center portion CE of the cable for differential signal transmission 40, and the front-side arm portion 51 covers both the signal line conductors 41 in viewing the front-side surface 20*a* from above in FIG. 8. In other words, a line "BL2" extending on the tip portion of the front-side arm portion 51 approaches a side surface of the signal line contact 25 positioned on the tip side of the front-side arm portion 51, the side surface being on the T-shaped ground contact 24 side.

Further, a dimension in the length of the rear-side arm portion 53 is also set so that a tip portion thereof extends beyond the center portion CE of the cable for differential signal transmission 40, and the rear-side arm portion 53 covers both the signal line conductors 41 in viewing the rear-side surface 20*b* from below therein. In other words, a line "BL3" extending on the tip portion of the rear-side arm portion 53 approaches a side surface of the signal line contact 25 positioned on the tip side of the rear-side arm portion 53, the side surface being on the L-shaped ground contact 22 side.

Here, FIG. 8 illustrates only one cable for differential signal transmission 40 side. However, the other cable for differential signal transmission 40 side is also similarly configured.

Even in the cable connector 50 according to the second embodiment formed as described above, the same function effect as that of the above-described first embodiment can be achieved. In addition to this, in the second embodiment, when the cable for differential signal transmission 40 is held by the front-side arm portions 51 and 52 and the rear-side arm portions 53 and 54, tilted movement of the cable for differential signal transmission 40 can be suppressed because the dimensions in the lengths of the front-side arm portions 51 and 52 and the rear-side arm portions 53 and 54 are set so as to extend beyond the center portion CE of the cable for differential signal transmission 40. In this manner, the cable 40 for differential signal transmission 40 can be more stably held.

Next, a third embodiment of the present invention will be described in detail with reference to the drawings. Note that the parts having the same functions as those of the first embodiment are denoted by the same reference symbols, and detailed explanation thereof is omitted.

Figure 9:
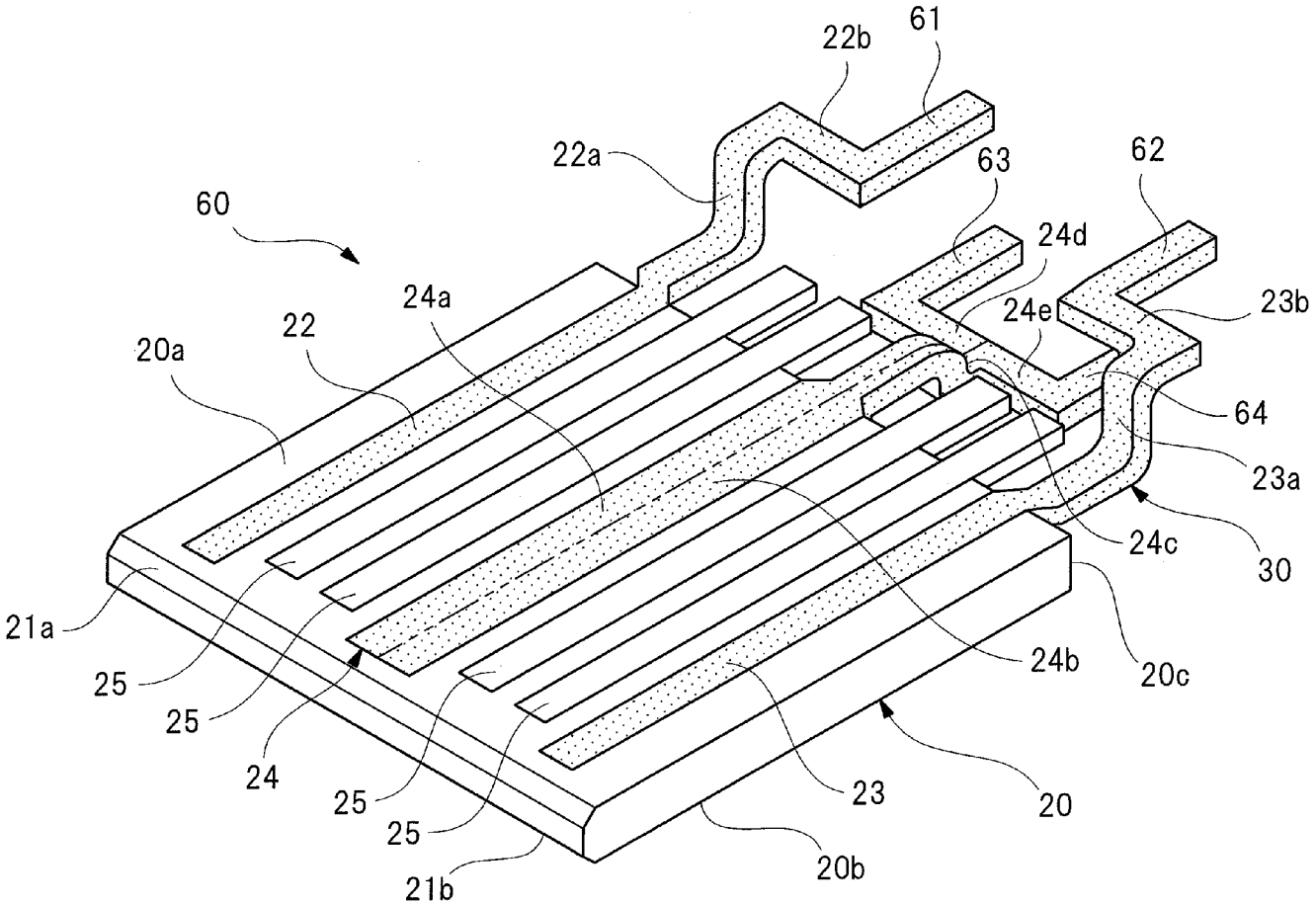
FIG. 9 is a perspective view illustrating a cable connector according to a third embodiment.

FIG. 9 is a perspective view illustrating a cable connector according to the third embodiment.

As illustrated in FIG. 9, a cable connector 60 according to the third embodiment is different from the cable connector 10 according to the first embodiment (see FIG. 1) in only that holding reinforcement portions 61 to 64 extending in the longitudinal direction of the cable for differential signal transmission 40 are integrally provided with the front-side arm portions 22*b* and 23*b* and the rear-side arm portions 24*d* and 24*e* integrally provided with the respective ground contacts 22 to 24.

Here, since the respective holding reinforcement portions 61 to 64 are integrally provided with the front-side arm portions 22*b* and 23*b* and the rear-side arm portions 24*d* and 24*e*, they are arranged on the center portion CE of the cable for differential signal transmission 40 (see FIG. 4B).

Even in the cable connector 60 according to the third embodiment formed as described above, the same function effect as that of the above-described first embodiment can be achieved. In addition to this, in the third embodiment, a wider area of the cable for differential signal transmission 40 can be held because the holding reinforcement portions 61 to 64 extending in the longitudinal direction of the cable for differential signal transmission 40 are integrally provided with the front-side arm portions 22*b* and 23*b* and the rear-side arm portions 24*d* and 24*e*, so that the electric characteristic can be more stabilized. Further, the cable for differential signal transmission 40 can be more easily connected to the cable connector 60 because the tilting of the cable for differential signal transmission 40 with respect to the cable connector 60 can be suppressed.

Next, a fourth embodiment of the present invention will be described in detail with reference to the drawings. Note that the parts having the same function as that of the above-described first embodiment are denoted by the same reference symbols, and detailed explanation thereof is omitted.

Figure 10:
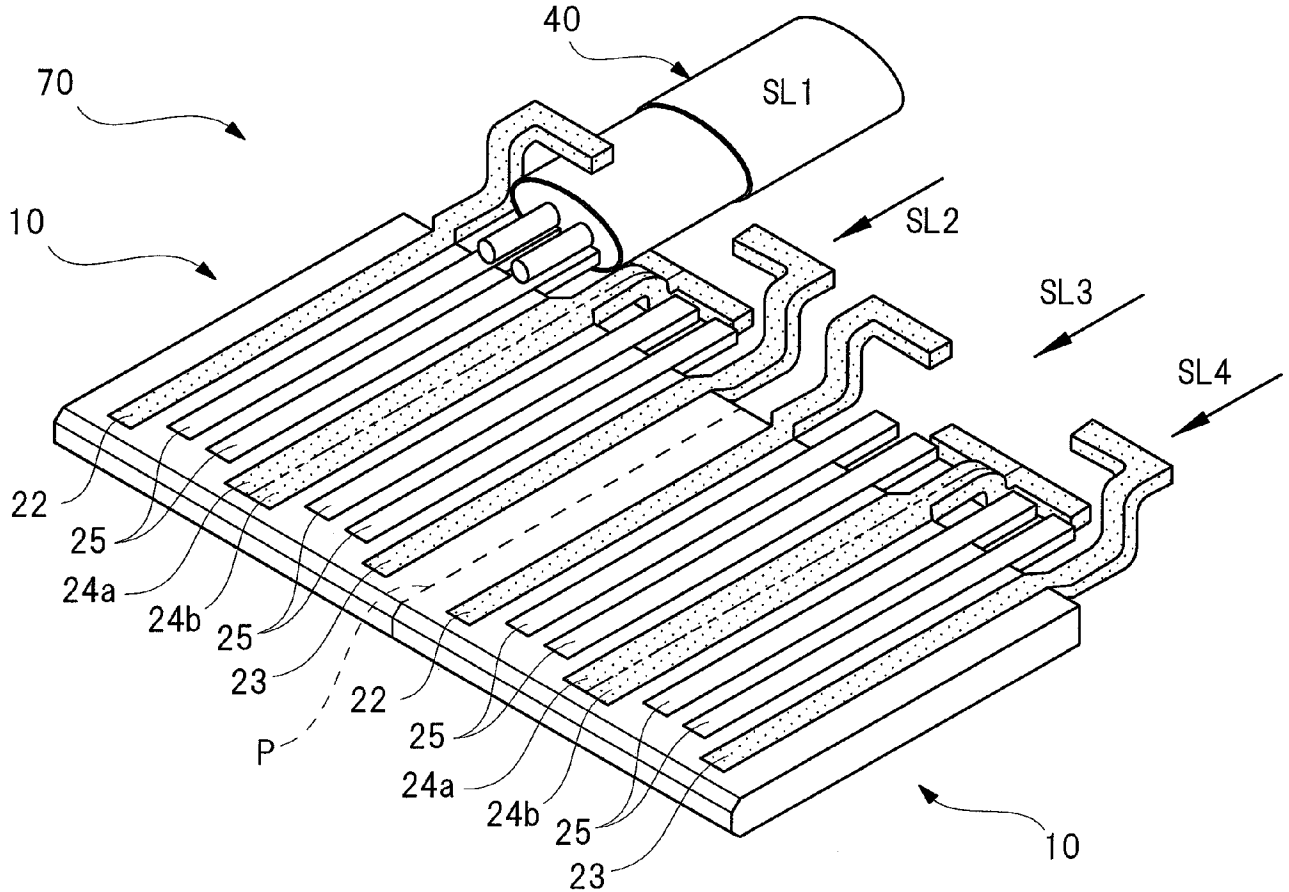
FIG. 10 is a perspective view illustrating a cable connector according to a fourth embodiment.

FIG. 10 is a perspective view illustrating a cable connector according to the fourth embodiment.

As illustrated in FIG. 10, a cable connector 70 according to the fourth embodiment is different from the cable connector 10 according to the first embodiment (see FIG. 1) in only that two cable connectors 10 according to the first embodiment are arranged integrally with each other on boundary of a broken line "P" so as to provide slots SL1 to SL4. In this manner, four cables for differential signal transmission 40 are electrically connectable so as to correspond to the respective slots SL1 to SL4. However, the number of cable connectors 10 to be connected is not limited to two but is any number, and three or more cable connectors 10 may be arranged integrally with each other.

Even in the cable connector 70 according to the fourth embodiment formed as described above, the same function effect as that of the above-described first embodiment can be achieved.

Next, a fifth embodiment of the present invention will be described in detail with reference to the drawings. Note that the parts having the same function as that of the above-described first embodiment are denoted by the same reference symbols, and detailed explanation thereof is omitted.

Figure 11:
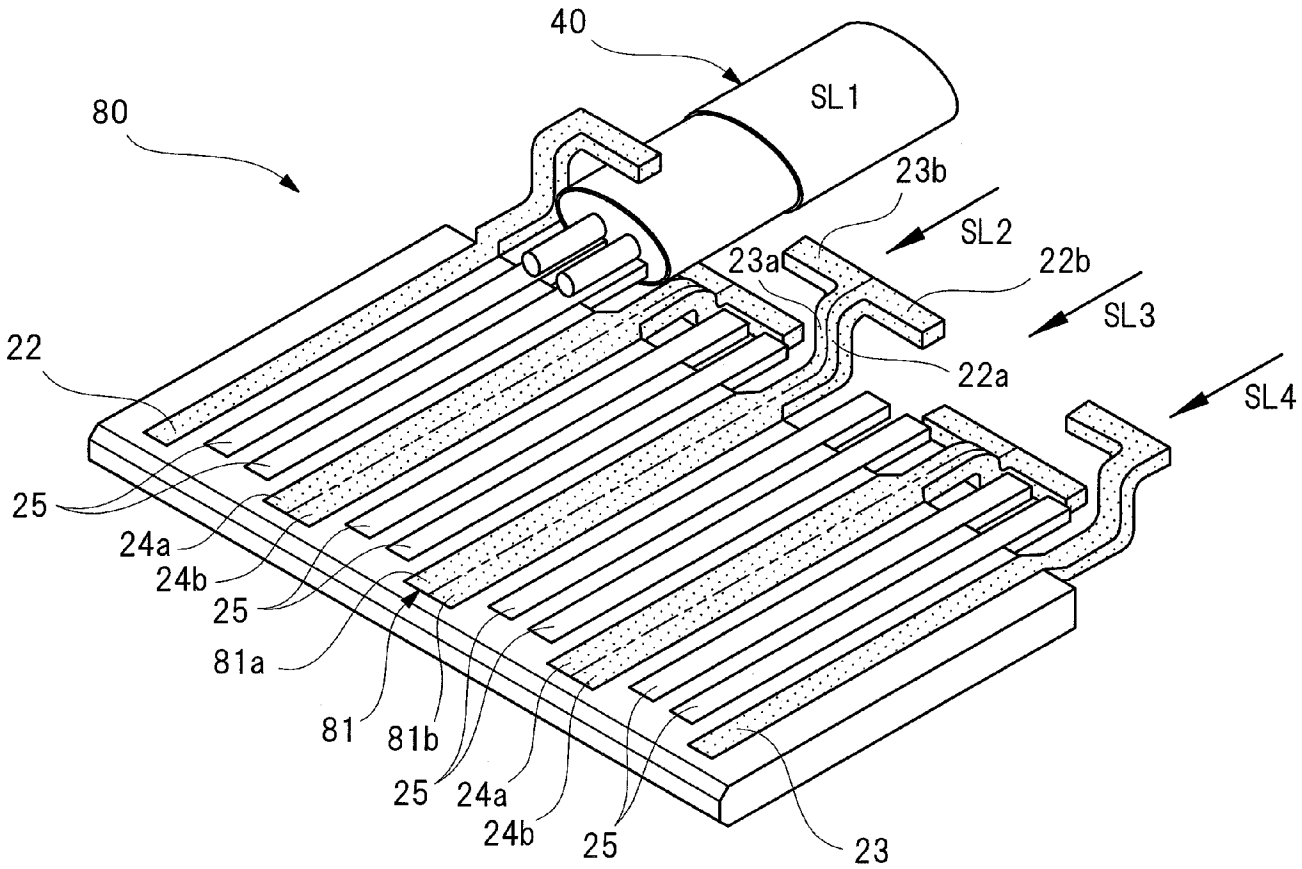
FIG. 11 is a perspective view illustrating a cable connector according to a fifth embodiment.

FIG. 11 is a perspective view illustrating a cable connector according to the fifth embodiment.

As illustrated in FIG. 11, a cable connector 80 according to the fifth embodiment is similar to the cable connector 70 according to the above-described fourth embodiment (see FIG. 10) in that the slots SL1 to SL4 are provided so that the four cables for differential signal transmission 40 are electrically connectable. However, in the cable connector 80, the L-shaped ground contact 23 and the L-shaped ground contact 22 in vicinity of the broken line P of the cable connector 70 are integrally formed with each other so as to form a T shape similar to the T-shaped ground contact 24. That is, a first portion 81*a* of this newly-provided T-shaped ground contact 81 has a function (second ground contact) similar to that of the L-shaped ground contact 23, and a second portion 81*b* of the T-shaped ground contact 81 has a function (first ground contact) similar to that of the L-shaped ground contact 22.

However, the number of the T-shaped ground contact 81 to be provided is not limited to one but is any number, and a plurality of the T-shaped ground contacts 81 may be provided. In this case, the T-shaped ground contact 24 and the T-shaped ground contact 81 may be alternately aligned.

Even in the cable connector 80 according to the fifth embodiment formed as described above, the same function effect as that of the above-described first embodiment can be achieved. In addition to this, in the fifth embodiment, a cable package density can be increased more than that of the cable connector 70 according to the fourth embodiment so as to contribute to space saving because the four cables for differential signal transmission 40 can be arranged to be close to each other by the same separated distance.

Next, a sixth embodiment of the present invention will be described in detail with reference to the drawings. Note that the parts having the same function as that of the above-described first embodiment are denoted by the same reference symbols, and detailed explanation thereof is omitted.

Figure 12:
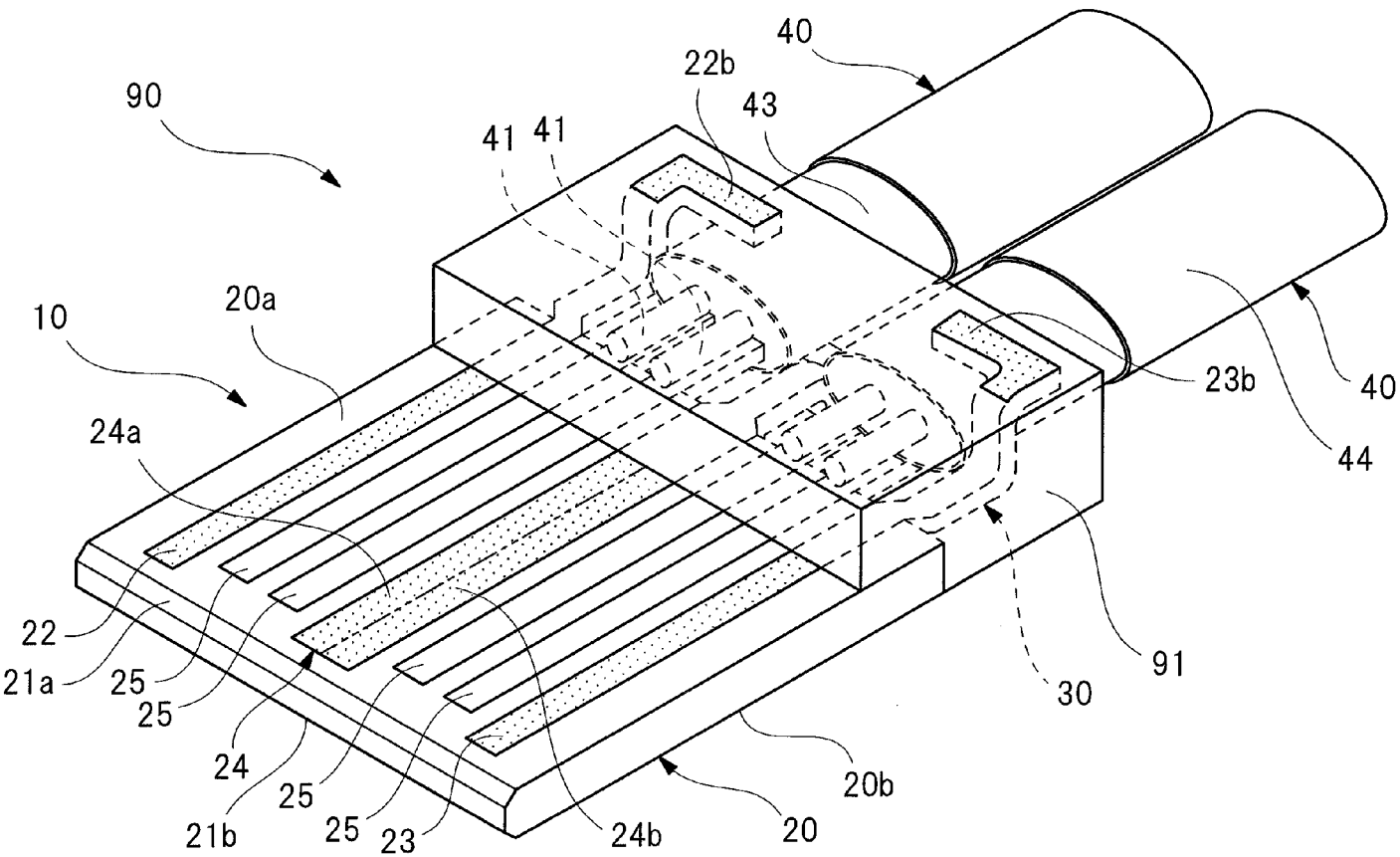
FIG. 12 is a perspective view illustrating a cable assembly according to a sixth embodiment.

FIG. 12 is a perspective view illustrating a cable assembly according to the sixth embodiment.

As illustrated in FIG. 12, a cable assembly 90 according to the sixth embodiment is different from the cable assembly CA according to the first embodiment (see FIG. 5) in only that connection portions between the cable connector 10 and the respective cables for differential signal transmission 40 are solidified by, for example, thermosetting epoxy resin as the insulating material. More specifically, a mold resin portion 91 is formed by solidifying the peripheries of the respective signal line conductors 41 and the respective signal line contacts 25 and the peripheries of the respective front-side arm portions 22*b* and 23*b* and the respective rear-side arm portions 24*d* and 24*e* under the state of holding the outer conductor 43 (see FIG. 5) by the epoxy resin in a substantially rectangular parallelepiped shape.

Here, the mold resin portion 91 can be formed by performing the above-described [Connecting Step] followed by [Mold Forming Step] using a molding machine (not illustrated). The molding machine using in this [Mold Forming Step] is provided with, for example, an upper mold and a lower mold, and the cable assembly CA illustrated in FIG. 5 is set in these upper and lower molds, and then, the melted epoxy resin is filled in a cavity formed of the set upper and lower molds, so that the mold resin portion 91 can be formed.

Even in the cable assembly 90 according to the sixth embodiment formed as described above, the same function effect as that of the above-described first embodiment can be achieved. In addition to this, in the sixth embodiment, the connection portions between the cable connector 10 and the respective cables for differential signal transmission 40 can be protected by the mold resin portion 91. Therefore, the connection portions between the cable connector 10 and the respective cables for differential signal transmission 40 are protected from moisture, dusts, and others, so that excellent electric connection can be maintained over a long period of time.

Next, a seventh embodiment of the present invention will be described in detail with reference to the drawings. Note that the parts having the same function as that of the above-described first embodiment are denoted by the same reference symbols, and detailed explanation thereof is omitted.

Figure 13:
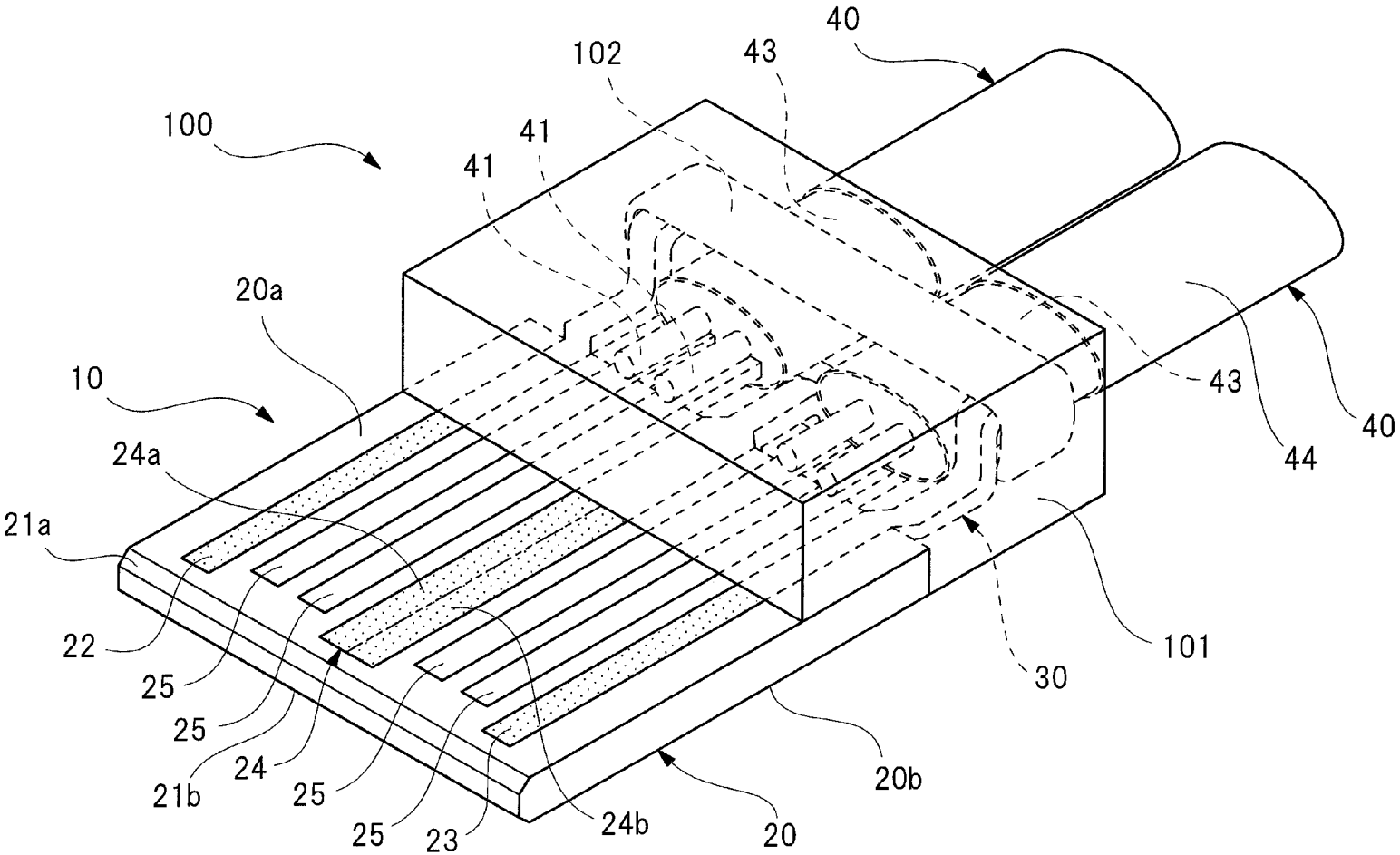
FIG. 13 is a perspective view illustrating a cable assembly according to a seventh embodiment.

FIG. 13 is a perspective view illustrating a cable assembly according to the seventh embodiment.

As illustrated in FIG. 13, a cable assembly 100 according to the seventh embodiment is similar to the cable assembly 90 according to the above-described sixth embodiment (see FIG. 12) in that a mold resin portion 101 is provided. The mold resin portion 101 is formed as similar to the mold resin portion 91 of the cable assembly 90. However, a copper tape (tape) 102 having conductive property is embedded inside the mold resin portion 101, and the copper tape 102 is wound in the peripheries of the respective outer conductors 43 of the respective cables for differential signal transmission 40 and the respective front-side arm portions 22*b* and 23*b* and the respective rear-side arm portions 24*d* and 24*e* by which the respective outer conductors 43 are held (see FIG. 5). The copper tape 102 is wound at a previous stage of the [Mold Forming step], that is, a stage previous to the setting of the cable assembly CA illustrated in FIG. 5 in the upper and lower molds and the formation of the mold resin portion 101. Note that not only the copper tape 102 but also, for example, a tape made of an aluminum foil as a base material can be used. Briefly speaking, the metal material is not specified as long as having the conductive property.

Even in the cable assembly 100 according to the seventh embodiment formed as described above, the same function effect as that of the above-described first embodiment can be achieved. In addition to this, in the seventh embodiment, the mold resin portion 101 can be formed under the state that the connection portions between the cable connector 10 and the respective cables for differential signal transmission 40 are fixed stronger than that of the cable assembly 90 according to the sixth embodiment. Therefore, a yield of the cable assembly 100 can be further improved. Also, the electric connection between the outer conductor 43 and the respective ground contacts 22 to 24 can be further stabilized, and, as a result, the electric characteristics can be further stabilized.

It is needless to say that the present invention is not limited to the foregoing embodiments and various modifications and alterations can be made within the scope of the present invention. For example, the respective embodiments describe the cable connectors 10, 50, 60, 70, and 80, to which the two or four cables for differential signal transmission 40 can be electrically connected. However, the present invention is not limited to them but is also applicable for one or three cables for differential signal transmission 40.

More specifically, in order to apply the present invention for the one cable for differential signal transmission 40, the L-shaped ground contact protruded toward the front-side surface 20*a* side and the L-shaped ground contact protruded toward the rear-side surface 20*b* side may be aligned. Further, in order to apply the present invention for the three cables for differential signal transmission 40, for example, the L-shaped ground contact protruded toward the respective front-side surfaces 20*a* side, the T-shaped ground contact protruded toward the rear-side surface 20*b* side, the T-shaped ground contact protruded toward the front-side surface 20*a* side, and the L-shaped ground contact protruded toward the rear-side surface 20*b* side may be aligned.

Still further, the above-described first embodiment describes the formation of the respective rear-side arm portions 24*d* and 24*e* of the T-shaped ground contact 24 so as to be elastically deformed by the weak force. However, the present invention is not limited to this, and the respective rear-side arm portions 24*d* and 24*e* may be configured so as not to be elastically deformed. In this case, the outer conductor 43 of the cable for differential signal transmission 40 is caused to abut on the respective rear-side arm portions 24*d* and 24*e* by elastic forces of the respective front-side arm portions 22*b* and 23*b* of the respective L-shaped ground contacts 22 and 23.

Still further, the second embodiment describes the formation of both the front-side arm portion 51 and the rear-side arm portion 53 so as to have the dimensions in the lengths which extend beyond the center portion CE of the cable for differential signal transmission 40. However, the present invention is not limited to this, and, for example, the dimension in the length of the front-side arm portion 51 may be the same dimension in the length of the front-side arm portion 22*b* in the first embodiment.

What is claimed is:

1. A cable connector which is electrically connected with a cable for differential signal transmission including: a pair of signal line conductors; an insulator provided in peripheries of the respective signal line conductors; and an outer conductor provided in periphery of the insulator, the cable connector comprising:

a connector board made of an insulating material;

a first ground contact and a second ground contact which are provided in the connector board and are electrically connected with the outer conductor;

a pair of signal line contacts which are provided between the respective ground contacts in the connector board through a space and are electrically connected with the respective signal line conductors; and a first arm portion and a second arm portion which are provided integrally with end portions of the respective ground contacts protruded from a side wall portion of the connector board, which mutually extend toward the respective signal line contacts, and which hold the outer conductor under a state that the respective signal line conductors are arranged in the respective signal line contacts.

2. The cable connector according to claim 1, wherein at least either one of the respective arm portions is elastically deformed, and a dimension in a distance between the respective arm portions is smaller than a dimension in a thickness of the outer conductor.

3. The cable connector according to claim 2, wherein the respective signal line conductors are pressed onto the respective signal line contacts by elastic force of the arm portions.

4. The cable connector according to claim 1, wherein the respective ground contacts are alternately aligned in the connector board so that the respective ground contacts positioned on both sides therein are formed in an L shape, and besides, so that the first ground contact and the second ground contact positioned between the respective ground contacts formed in the L shape are formed integrally with each other in a T shape.

5. The cable connector according to claim 1, wherein a dimension in a length of at least either one of the respective arm portions is set to a dimension in a length which extends beyond a center portion of the cable for differential signal transmission.

6. The cable connector according to claim 1 further comprising a holding reinforcement portion extending in a longitudinal direction of the cable for differential signal transmission, the holding reinforcement portion provided integrally with the respective arm portions.

7. The cable connector according to claim 1, wherein peripheries of the respective arm portions are solidified by an insulating material under a state that the outer conductor is held by the respective arm portions.

8. The cable connector according to claim 1 further comprising a tape having conductive property wound in peripheries of the respective arm portions and the outer conductor.

9. A cable assembly including: a cable for differential signal transmission; and a cable connector which is electrically connected with the cable for differential signal transmission, the cable for differential signal transmission comprising:

a pair of signal line conductors;

an insulator provided in peripheries of the respective signal line conductors; and an outer conductor provided in periphery of the insulator, and the cable connector comprising:

a connector board made of an insulating material;

a first ground contact and a second ground contact which are provided in the connector board and are electrically connected with the outer conductor;

a pair of signal line contacts which are provided between the respective ground contacts in the connector board through a space and are electrically connected with the respective signal line conductors; and a first arm portion and a second arm portion which are provided integrally with end portions of the respective ground contacts protruded from a side wall portion of the connector board, which mutually extend toward the respective signal line contacts, and which hold the outer conductor under a state that the respective signal line conductors are arranged in the respective signal line contacts.

10. The cable assembly according to claim 9, wherein at least either one of the respective arm portions is elastically deformed, and a dimension in a distance between the respective arm portions is smaller than a dimension in a thickness of the outer conductor.

11. The cable assembly according to claim 10, wherein the respective signal line conductors are pressed onto the respective signal line contacts by elastic force of the arm portions.

12. The cable assembly according to claim 9, wherein the respective ground contacts are alternately aligned in the connector board so that the respective ground contacts positioned on both sides therein are formed in an L shape, and besides, so that the first ground contact and the second ground contact positioned between the respective ground contacts formed in the L shape are formed integrally with each other in a T shape.

13. The cable assembly according to claim 9, wherein a dimension in a length of at least either one of the respective arm portions is set to a dimension in a length which extends beyond a center portion of the cable for differential signal transmission.

14. The cable assembly according to claim 9 further comprising a holding reinforcement portion extending in a longitudinal direction of the cable for differential signal transmission, the holding reinforcement portion provided integrally with the respective arm portions.

15. The cable assembly according to claim 9, wherein peripheries of the respective arm portions are solidified by an insulating material under a state that the outer conductor is held by the respective arm portions.

16. The cable assembly according to claim 9 further comprising a tape having conductive property wound in peripheries of the respective arm portions and the outer conductor.

17. A method of manufacturing a cable assembly comprising:

a cable preparing step of preparing a cable for differential signal transmission including a pair of signal line conductors, an insulator provided in peripheries of the respective signal line conductors, and an outer conductor provided in periphery of the insulator;

a cable-connector preparing step of preparing a cable connector including a connector board made of an insulating material, a first ground contact and a second ground contact which are provided in the connector board and are electrically connected with the outer conductor, a pair of signal line contacts which are provided between the respective ground contacts in the connector board through a space and are electrically connected with the respective signal line conductors, and a first arm portion and a second arm portion which are provided integrally with end portions of the respective ground contacts protruded from a side wall portion of the connector board and which mutually extend toward the respective signal line contacts; and a connecting step of electrically connecting between the respective signal line conductors and the respective signal line contacts under a state that the respective signal line conductors are arranged in the respective signal line contacts, and besides, the outer conductor is arranged between the respective arm portions so that the outer conductor is held by the respective arm portions.

18. The method of manufacturing the cable assembly according to claim 17, wherein the connecting step is followed by a mold forming step of solidifying the peripheries of the respective arm portions by an insulating material.

* * * * *